US012245736B2

(12) United States Patent
Isaacs

(10) Patent No.: US 12,245,736 B2
(45) Date of Patent: Mar. 11, 2025

(54) CLEANER HEAD FOR A VACUUM CLEANER

(71) Applicant: Dyson Technology Limited, Wiltshire (GB)

(72) Inventor: Andrew John Isaacs, Gloucester (GB)

(73) Assignee: Dyson Technology Limited, Wiltshire (GB)

( * ) Notice: Subject to any disclaimer, the term of this patent is extended or adjusted under 35 U.S.C. 154(b) by 446 days.

(21) Appl. No.: 17/612,876

(22) PCT Filed: Apr. 17, 2020

(86) PCT No.: PCT/GB2020/050967
§ 371 (c)(1),
(2) Date: Nov. 19, 2021

(87) PCT Pub. No.: WO2020/245560
PCT Pub. Date: Dec. 10, 2020

(65) Prior Publication Data

US 2022/0079402 A1 Mar. 17, 2022

(30) Foreign Application Priority Data

Jun. 3, 2019 (GB) ..... 1907853
Feb. 20, 2020 (GB) ..... 2002358

(51) Int. Cl.
*A47L 9/04* (2006.01)
*A46B 13/00* (2006.01)

(52) U.S. Cl.
CPC ..... *A47L 9/0477* (2013.01); *A46B 13/006* (2013.01)

(58) Field of Classification Search
CPC ..... A46B 13/006; A46B 9/028; A46B 13/001; A46B 13/00; A47L 5/26; A47L 9/04;
(Continued)

(56) References Cited

U.S. PATENT DOCUMENTS 21,451 A 9/1858 Shaler
271,971 A 2/1883 Batchelder
(Continued)

FOREIGN PATENT DOCUMENTS

CH 168699 A 4/1934
CH 598423 A5 4/1978
(Continued)

OTHER PUBLICATIONS

Office Action received for Japanese Patent Application No. 2021-571805, mailed on Jan. 17, 2023, 6 pages (3 pages of English Translation and 3 pages of Original Document).
(Continued)

*Primary Examiner* — Eric J Rosen
*Assistant Examiner* — John C Merino
(74) *Attorney, Agent, or Firm* — Tucker Ellis LLP

(57) ABSTRACT

A cleaner head for a vacuum cleaner includes a suction cavity comprising an opening through which debris enters the cleaner head, and an outlet. An agitator is mounted in the suction cavity in a cantilevered manner for rotation relative thereto. The agitator includes a core having a first, free end, a second end remote from the free end, and upstanding helical ridges extending between the free end and the second end, and a row of bristles located between the helical ridges and inclined relative to the core in a direction extending towards the free end of the core.

20 Claims, 15 Drawing Sheets

(58) Field of Classification Search
CPC . A47L 9/0477; A47L 9/00; A47L 9/02; A47L 9/411; A47L 9/0483; A47L 9/0673; A47L 9/0444
See application file for complete search history.

(56) References Cited

U.S. PATENT DOCUMENTS

| | | | | |
|---|---|---|---|---|
| 1,815,084 | A | 7/1931 | White | |
| 1,889,224 | A | 11/1932 | Smellie | |
| 2,032,345 | A | 3/1936 | Callan | |
| 2,577,339 | A | 12/1951 | Lee | |
| 2,924,838 | A | 2/1960 | Jones et al. | |
| 2,941,232 | A | 6/1960 | Clayton, Jr. | |
| 3,289,239 | A | 12/1966 | Max et al. | |
| 3,828,387 | A | 8/1974 | Liebscher | |
| 4,177,536 | A | 12/1979 | Powers | |
| 4,307,479 | A * | 12/1981 | Mertes | A46B 7/04 15/207.2 |
| 4,372,004 | A | 2/1983 | Vermillion | |
| 4,402,102 | A | 9/1983 | Al-Samman | |
| 4,531,249 | A | 7/1985 | Sternberg | |
| 4,654,927 | A | 4/1987 | Novinger | |
| 5,193,243 | A | 3/1993 | Stegens | |
| 5,237,716 | A | 8/1993 | Lisec | |
| 6,122,798 | A | 9/2000 | Kobayashi et al. | |
| 6,125,495 | A | 10/2000 | Berg et al. | |
| 6,539,575 | B1 | 4/2003 | Cohen | |
| 8,601,643 | B2 | 12/2013 | Eriksson | |
| 9,414,728 | B2 | 8/2016 | Van Der Kooi et al. | |
| 9,648,999 | B2 | 5/2017 | Uphoff et al. | |
| 9,763,549 | B2 | 9/2017 | Hyun et al. | |
| 9,833,115 | B2 | 12/2017 | Eriksson | |
| 11,234,568 | B2 | 2/2022 | Udy et al. | |
| 2002/0060140 | A1 | 5/2002 | Nakamura et al. | |
| 2003/0066149 | A1 | 4/2003 | Stegens et al. | |
| 2004/0221418 | A1 | 11/2004 | Nam et al. | |
| 2006/0272122 | A1 | 12/2006 | Butler et al. | |
| 2009/0229075 | A1 | 9/2009 | Eriksson | |
| 2010/0107357 | A1 | 5/2010 | Odachi et al. | |
| 2010/0229330 | A1 | 9/2010 | Park et al. | |
| 2012/0011680 | A1 | 1/2012 | Owen et al. | |
| 2012/0297570 | A1 | 11/2012 | Fujita et al. | |
| 2013/0091663 | A1 | 4/2013 | Mersmann | |
| 2013/0192024 | A1 | 8/2013 | Eriksson | |
| 2014/0165328 | A1 | 6/2014 | Jang et al. | |
| 2014/0331446 | A1 | 11/2014 | Eriksson | |
| 2015/0313431 | A1 | 11/2015 | Eriksson | |
| 2015/0327743 | A1 | 11/2015 | Van Der Kooi et al. | |
| 2016/0073841 | A1 | 3/2016 | Eriksson | |
| 2016/0166052 | A1 | 6/2016 | Kasper et al. | |
| 2017/0209008 | A1 | 7/2017 | Isley et al. | |
| 2018/0070785 | A1* | 3/2018 | Udy | A47L 9/1409 |
| 2018/0125315 | A1 | 5/2018 | Kasper, Jr. et al. | |
| 2018/0255991 | A1 | 9/2018 | Der Marderosian et al. | |
| 2018/0289226 | A1 | 10/2018 | De Wit | |
| 2019/0320865 | A1* | 10/2019 | Brown | A47L 9/2852 |
| 2021/0068602 | A1 | 3/2021 | Carter | |
| 2021/0137329 | A1 | 5/2021 | Williamson et al. | |
| 2022/0233038 | A1 | 7/2022 | Goncalves | |

FOREIGN PATENT DOCUMENTS

| | | | |
|---|---|---|---|
| CN | 1387411 | A | 12/2002 |
| CN | 1997309 | A | 7/2007 |
| CN | 101984742 | A | 3/2011 |
| CN | 102334949 | A | 2/2012 |
| CN | 102462450 | A | 5/2012 |
| CN | 102843946 | A | 12/2012 |
| CN | 203676995 | U | 7/2014 |
| CN | 203709941 | U | 7/2014 |
| CN | 104395529 | A | 3/2015 |
| CN | 204192514 | U | 3/2015 |
| CN | 104703525 | A | 6/2015 |
| CN | 104703526 | A | 6/2015 |
| CN | 204600362 | U | 9/2015 |
| CN | 105395133 | A | 3/2016 |
| CN | 105592764 | A | 5/2016 |
| CN | 105902239 | A | 8/2016 |
| CN | 205625807 | U | 10/2016 |
| CN | 206354985 | U | 7/2017 |
| CN | 206596998 | U | 10/2017 |
| CN | 108471917 | A | 8/2018 |
| CN | 108937746 | A | 12/2018 |
| DE | 7837324 | | 5/1980 |
| DE | 202009001640 | U1 | 7/2010 |
| EP | 0803223 | A2 | 10/1997 |
| EP | 1542574 | A1 | 6/2005 |
| EP | 3289946 | | 3/2018 |
| GB | 0364362 | A | 1/1932 |
| GB | 0389743 | A | 3/1933 |
| GB | 0411801 | A | 6/1934 |
| GB | 0513909 | | 10/1939 |
| GB | 0516291 | A | 12/1939 |
| GB | 0535258 | A | 4/1941 |
| GB | 0690152 | A | 4/1953 |
| GB | 1067851 | | 5/1967 |
| GB | 1251690 | | 10/1971 |
| GB | 2241430 | A | 9/1991 |
| GB | 2518882 | | 4/2015 |
| GB | 2543314 | A | 4/2017 |
| GB | 2569313 | A | 6/2019 |
| JP | 61-194470 | U | 12/1986 |
| JP | 62-231610 | A | 10/1987 |
| JP | 02-077219 | A | 3/1990 |
| JP | 02-104322 | A | 4/1990 |
| JP | 02-149239 | A | 6/1990 |
| JP | 02-172430 | A | 7/1990 |
| JP | 03-128046 | U | 12/1991 |
| JP | 05-095866 | A | 4/1993 |
| JP | 06-142018 | A | 5/1994 |
| JP | 07-023884 | A | 1/1995 |
| JP | 07-088062 | A | 4/1995 |
| JP | 07-124085 | A | 5/1995 |
| JP | 11-318781 | A | 11/1999 |
| JP | 2004-222739 | A | 8/2004 |
| JP | 2011-182874 | A | 9/2011 |
| JP | 2012-005551 | A | 1/2012 |
| JP | 4892377 | B2 | 3/2012 |
| JP | 2013-009809 | A | 1/2013 |
| JP | 2015-192787 | | 11/2015 |
| JP | 2016-510615 | A | 4/2016 |
| JP | 2017-127640 | A | 7/2017 |
| JP | 2018-075328 | A | 5/2018 |
| KR | 10-2007-0028561 | A | 3/2007 |
| WO | 2006/008983 | A1 | 1/2006 |
| WO | 2014/140935 | A2 | 9/2014 |
| WO | 2014/177171 | | 11/2014 |
| WO | 2016/170853 | A1 | 10/2016 |
| WO | 2017/064462 | A1 | 4/2017 |
| WO | 2017/125704 | A1 | 7/2017 |

OTHER PUBLICATIONS

International Search Report and Written Opinion received for PCT Patent Application No. PCT/GB2018/053595, mailed on Jan. 30, 2019, 8 pages.

International Search Report and Written Opinion received for PCT Patent Application No. PCT/GB2020/050966, mailed on Jun. 24, 2020, 11 pages.

International Search Report and Written Opinion received for PCT Patent Application No. PCT/GB2020/050967, mailed on Jun. 24, 2020, 11 pages.

Notification of Reason(S) For Refusal received for Korean Patent Application No. 10-2020-7019768, mailed on Nov. 1, 2021, 8 pages.

Search Report dated Jun. 6, 2018, directed to GB Application No. 1720704.4; 2 pages.

Search Report Received for GB Application No. 1907852.6, mailed on Nov. 21, 2019, 1 page.

Search Report received for GB Application No. 1907853.4, mailed on Nov. 21, 2019, 1 page.

(56) References Cited

OTHER PUBLICATIONS

The First Office Action dated Mar. 2, 2021, directed to CN Application No. 201880080025.3; 18 pages.
Office Action received for Chinese Patent Application No. 202080040656.X, mailed on May 7, 2022, 19 pages (11 pages of English Translation and 8 pages of Office Action).
Office Action received for Japanese Patent Application No. 2021-571806, mailed on Jan. 24, 2023, 12 pages (6 pages of English Translation and 6 pages of Original Document).
Office Action received for Korean Patent Application No. 10-2021-7043286, mailed on Aug. 30, 2023, 11 pages (5 pages of English Translation and 6 pages of Original Document).
Office Action received for Korean Patent Application No. 10-2021-7043287, mailed on Aug. 30, 2023, 10 pages (5 pages of English Translation and 5 pages of Original Document).
Office Action received for Chinese Patent Application No. 202080040739.9, mailed on May 25, 2022, 19 pages (11 pages of English Translation and 8 pages of Original Document).
Office Action received for Chinese Patent Application No. 202080040656.X, mailed on Jun. 27, 2023, 18 pages (11 pages of English Translation and 7 pages of Original Document).

* cited by examiner

CLEANER HEAD FOR A VACUUM CLEANER

CROSS-REFERENCE TO PRIOR APPLICATION

This application is a § 371 National Stage Application of PCT International Application No. PCT/GB2020/050967 filed Apr. 17, 2020, which claims the priority of United Kingdom Application No. 1907853.4, filed Jun. 3, 2019 and United Kingdom Application No. 2002358.6, filed Feb. 20, 2020, each of which are herein incorporated by reference in their entirety.

FIELD OF THE INVENTION

The present invention relates to a cleaner head for a vacuum cleaner.

BACKGROUND OF THE INVENTION

A vacuum cleaner typically comprises a main body containing dirt and dust separating apparatus, a cleaner head connected to the main body and having an opening, and a motor-driven fan unit for drawing dirt-bearing air through the opening and the cleaner head, and into the main body. The opening is directed downwardly to face the floor surface to be cleaned. The dirt-bearing air is conveyed to the separating apparatus so that dirt and dust can be separated from the air before the air is expelled to the atmosphere. The separating apparatus can include one or more of a filter, a filter bag and a cyclonic arrangement.

A driven agitator, usually in the form of a brush bar, may be rotatably mounted within a suction cavity of the cleaner head. The brush bar typically comprises an elongate cylindrical core bearing bristles which extend radially outward from the core. The opening is in the form of an aperture, usually an elongate, rectangular aperture, defined by a sole plate located on the base of the cleaner head. The brush bar may be mounted within the suction cavity so that the bristles protrude by a small extent through the opening.

The brush bar is activated mainly when the vacuum cleaner is used to clean carpeted surfaces. Rotation of the brush bar may be driven by an electric motor powered by a power supply derived from the main body of the vacuum cleaner, or by a turbine driven by an air flow passing through or into the cleaner head. The brush bar may be driven by the motor via a drive belt, or may be driven directly by the motor, so as to rotate within the suction cavity. Rotation of the brush bar causes the bristles to sweep along the surface of the carpet, agitating both the fibres of the carpet and any dust or other detritus located on the surface of the carpet and/or between fibres of the carpet, and resulting in a significant amount of energy being imparted to the dust. With the brush bar rotating in such a direction that the bristles move from the front edge of the opening towards the rear edge, the rotating bristles sweep dust rearwardly through the opening and into the suction cavity. The suction of air causes air to flow underneath the sole plate and around the brush bar to help lift the dirt and dust from the surface of the carpet and then carry it from the opening through the cleaner head towards the separating apparatus.

During the passage of agitated dust through the dirty air inlet, long strands of debris, for example hair or thread or the like, may become wrapped around the brush bar or a mounting thereof. This may lead to an increased torque on the brush bar, and a sufficient build-up of strands of debris on the brush bar may lead to failure of the brush bar and a reduced pick-up performance.

SUMMARY OF THE INVENTION

In a first aspect the present invention provides a cleaner head for a vacuum cleaner, the cleaner head comprising:

- a suction cavity comprising an opening through which debris enters the cleaner head, and a first air outlet; and
- an agitator mounted in the suction cavity in a cantilevered manner for rotation relative thereto, the agitator being conical in shape and having a first, free end and a second end which has a larger diameter than the first end;
- wherein the suction cavity comprises a second air outlet located adjacent the free end of the agitator, and the cleaner head defines a first airflow path extending downstream of the suction cavity from the first air outlet towards an outlet of the cleaner head, and a second airflow path extending downstream of the suction cavity from the second air outlet towards the first airflow path.

During the use of the cleaner head, any debris which has become wrapped around the agitator is encouraged by the conical shape of the agitator to migrate along the agitator towards the free end, where it can become released from the agitator. In order to minimise the risk of this released debris becoming re-wrapped around the agitator before it is conveyed away from the agitator within an airflow which is passing through the suction cavity, the suction cavity comprises a second air outlet located adjacent the free end of the agitator. A first part of the airflow passing through the suction cavity leaves the suction cavity through the first air outlet, and a second part of this airflow leaves the suction cavity through the second air outlet. The first part of the airflow, generally containing dust and other detritus which has been agitated from a floor surface by the agitator, passes along a first airflow path extending from the first air outlet to an outlet of the cleaner head. The second part of the airflow, into which debris which has been released from the agitator generally becomes entrained, passes along a second airflow path extending from the second air outlet towards the first airflow path so as to merge with the first part of the airflow between the first air outlet and the outlet of the cleaner head, and thus before any part of the airflow is emitted from the cleaner head.

As used herein, the term "conical shape" includes both conical and frustoconical shapes. The cone angle of a conical shape is the angle subtended between the longitudinal axis of the conical shape and the external conical surface of the conical shape. In a preferred embodiment, the cone angle is 7°.

As used herein the term "debris" refers to strands which have the potential to wrap around the agitator during operation of the cleaner head. For example, debris may be considered to comprise strands having a length which is greater than the maximum circumference of the agitator. Examples of debris include hairs, threads and other relatively long fibres and strands.

The agitator preferably comprises a conical core having helical ridges upstanding from an external conical surface of the core, and a row of bristles located between the helical ridges. The bristles may be mounted on a flexible bristle base which is inserted between the upstanding ridges of the core. The bristles may be arranged so as to bend freely, for example, against the upper surfaces of the helical ridges, as debris becomes wrapped around the agitator. This can further encourage the migration of the debris towards the free end of the agitator. For example, the bristles may be formed from relatively thin strands of nylon or carbon fibre. As measured in a direction perpendicular to the longitudinal axis of the core, the height of the upstanding ridges is preferably at least 50% of the height of the bristles. This can prevent the debris from sinking between the bristles towards the bristle base upon which the bristles are mounted, and so becoming trapped within the row of bristles.

The cleaner head preferably comprises a bottom surface, or sole plate, in which the opening is formed. The longitudinal axis of the agitator is preferably inclined at an acute angle to a plane containing the opening of the cleaner head. In a preferred embodiment the cone angle is 7°. In use, the lowermost portion of the external surface of the core is preferably parallel to the plane containing the opening so that the lowermost portion of the external surface of the core is evenly spaced along its length from this plane. The opening is preferably trapezoidal in shape. The opening may be defined by a relatively long leading edge, and relatively long trailing edge, and two side edges each extending between the leading edge and the trailing edge. The leading edge may be perpendicular to the side edges, or, as in a preferred embodiment, it may be inclined relative to the side edges so that it subtends an acute angle with one side edge and an obtuse angle with the other side edge.

The suction cavity is preferably defined by a conical housing of the cleaner head. The housing preferably has substantially the same shape as the agitator.

Each of the first air outlet and the second air outlet is preferably located rearwardly of the agitator. The second air outlet is preferably located directly behind the free end of the agitator, whereas the first air outlet is preferably located midway between the free end and the second end of the agitator. Where the agitator comprises a helical row of bristles, we have found that these locations of the first and second air outlets, and thus the directions in which air passes through the suction cavity, can encourage debris to wrap around the agitator in a direction which is generally orthogonal to the longitudinal axis of the agitator, as opposed to a direction extending generally along or alongside the helical row of bristles. This can promote the migration of debris along the agitator and its subsequent release from the agitator.

The first air outlet and the second air outlet are preferably spaced in a direction extending parallel to the longitudinal axis of the agitator.

The first airflow path is preferably defined, at least in part, by a neck for conveying air from the first air outlet to the outlet of the cleaner head. The neck preferably comprises a connector for connecting the cleaner head to a vacuum cleaner. The first part of the airflow and the second part of the airflow preferably merge within the neck.

The second airflow path is preferably defined, at least in part, by a duct for conveying air from the second air outlet to an air inlet port formed in the neck and from which the second part of the airflow enters the first part of the airflow. The air inlet port is located between the first air outlet and the outlet of the cleaner head. The second airflow path thus extends away from the suction cavity in parallel to the portion of the first airflow path located upstream from the air inlet port.

The duct, and thus the second airflow path, preferably extends externally of the housing from the second air outlet to the neck. To minimise turbulence, the duct is preferably curved, and preferably curves through 90° between the second air outlet and the air inlet port. The duct may have a constant or a varying radius of curvature along its length. To facilitate manufacture, the duct is preferably integral with at least part of the neck and/or at least part of the housing.

The cleaner head preferably comprises a single conical agitator which has a free end located adjacent to, but spaced from a side wall of the suction cavity, and a second end, located opposite to free end, which has a larger diameter than the free end. The agitator is preferably mounted, at or towards the second end of the agitator, to a drive for driving the rotation of the agitator relative to the suction cavity. The drive preferably comprises a motor located externally of the agitator, and a belt connecting the agitator to the motor. Alternatively, the motor may be located within the agitator. To maximise cleaning performance by preventing released debris from becoming trapped between the free end of the agitator and the side wall of the housing, the spacing between the free end of the agitator and the side wall is preferably in the range from 2 to 10 mm, more preferably in the range from 3 to 5 mm.

As the cleaner head is manoeuvred over a carpeted floor surface, a portion of the carpet can become raised and drawn into the suction cavity through the opening, in view of the relatively low air pressure generated within the suction cavity by the vacuum cleaner. This can cause the raised portion of the carpet to contact the agitator, in particular the bristles and the helical ridges upstanding from the external surface of the core. When debris has become wrapped around the agitator, the action of the carpet pressing upon the agitator can encourage this debris to become more tightly wrapped around the agitator. We have observed that tightly wrapping the debris around the agitator can promote its migration towards the free end of the agitator.

So as not to be reliant upon the movement of carpet into the suction cavity to urge debris against the agitator, to promote migration of the wrapped debris along the agitator the cleaner head preferably comprises an agitator engaging member for pressing against the agitator any debris which has become wrapped around the agitator.

In a second aspect, the present invention provides a cleaner head for a vacuum cleaner, the cleaner head comprising:

- a suction cavity comprising an opening through which debris enters the cleaner head, and an outlet;
- an agitator mounted in the suction cavity in a cantilevered manner for rotation relative thereto, the agitator comprising a core which is conical in shape and has a first, free end and a second end which has a larger diameter than the first end; and
- an agitator engaging member for pressing against the agitator any debris which has become wrapped around the agitator.

The engaging member preferably extends substantially the entire length of the agitator. With rotation of the agitator within the suction cavity, this enables the engaging member to press against substantially the entire length of the row of bristles and the ridges of the core. The engaging member preferably extends in a direction which is inclined at the cone angle to the longitudinal axis of the agitator. This can allow the engaging member to be aligned relative to the agitator so that it lies substantially parallel to a portion, preferably an upper portion of the external surface of the core of the agitator. This can enable the engaging member to apply a substantially uniform force to the agitator along its length.

The engaging member is preferably biased towards the agitator. The engaging member may comprise a plate or bar which is biased towards the agitator by one or more springs or other resilient members. Alternatively, the engaging member may be in the form of a resilient member which is biased internally towards the agitator. The resilient member may comprise a strip of resilient material, which preferably has a substantially uniform width. The width of the engaging member is selected such that the engaging member presses wrapped debris against at least the bristles of the agitator, and preferably against also the helical ridges of the core. In a preferred embodiment, the width of the strip of resilient material is in the range from 2 to 5 mm.

The engaging member may be mounted on any surface of the cleaner head so as to engage the agitator. The engaging member is preferably located opposite to the opening through which debris enters the cleaner head so that it is located opposite to any raised carpet which is also pressing against the agitator. This can enable the forces being applied to the agitator by the carpet and the engaging member to be balanced. In a preferred embodiment, the engaging member is mounted on the housing which defines the suction cavity.

As mentioned above, the bristles may be arranged so as to bend freely as debris becomes wrapped around the agitator so as to further encourage the migration of the debris towards the free end of the agitator. These bristles may be mounted on the bristle base so as to extend substantially perpendicular to the bristle base. As debris becomes wrapped around the agitator, the bristles flex towards an upper end of an upstanding ridge of the core, and/or so as to at least partially overlie adjacent bristles.

As an alternative, the bristles may be inclined relative to the bristle base, and thus relative to the external surface of the core, in a direction extending towards the free end of the core. This can reduce the risk of any wrapped debris becoming lodged between adjacent bristles and not migrating towards the bristle base, and so can further promote the migration of wrapped threads towards the free end of the agitator.

In a third aspect the present invention provides a cleaner head for a vacuum cleaner, the cleaner head comprising:

- a suction cavity comprising an opening through which debris enters the cleaner head, and an outlet;
- an agitator mounted in the suction cavity in a cantilevered manner for rotation relative thereto, the agitator comprising:
  - a core having a first, free end, a second end remote from the free end, and upstanding helical ridges extending between the free end and the second end; and
  - a row of bristles located between the helical ridges and inclined relative to the core in a direction extending towards the free end of the core.

The row of bristles extends in a row direction, and the bristles are preferably inclined at an acute angle to, and towards, the row direction. The row of bristles may be formed by securing the bristles to the flexible bristle base, and using a hot rolling technique to angle the bristles towards the bristle base. The row of bristles is then inserted between the ridges of the core so that the row of bristles adopts a helical shape which extends towards the free end of the core in a helical direction, and so that the bristles are inclined towards the free end of the core at an acute angle to the helical direction. The acute angle is preferably in the range from 20 to 60°, more preferably in the range from 30 to 50°. The row of bristles may comprise a continuous row of bristles, or it may comprise a plurality of discrete bristle tufts.

Features described above in connection with the first aspect of the invention are equally applicable to the second to third aspects of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

FIGS. 1 to 5 are external views of a first embodiment of a cleaner head 10 for a vacuum cleaner. The cleaner head 10 comprises a conical front housing 12, a rear housing 14 connected to the front housing 12, and a sole plate 16 connected to the front housing 12. One or more of the rear housing 14 and the sole plate 16 may be integral with the front housing 12, and are preferably formed from plastics material. In use, the sole plate 16 is placed upon the floor surface to be cleaned.

Figure 1:
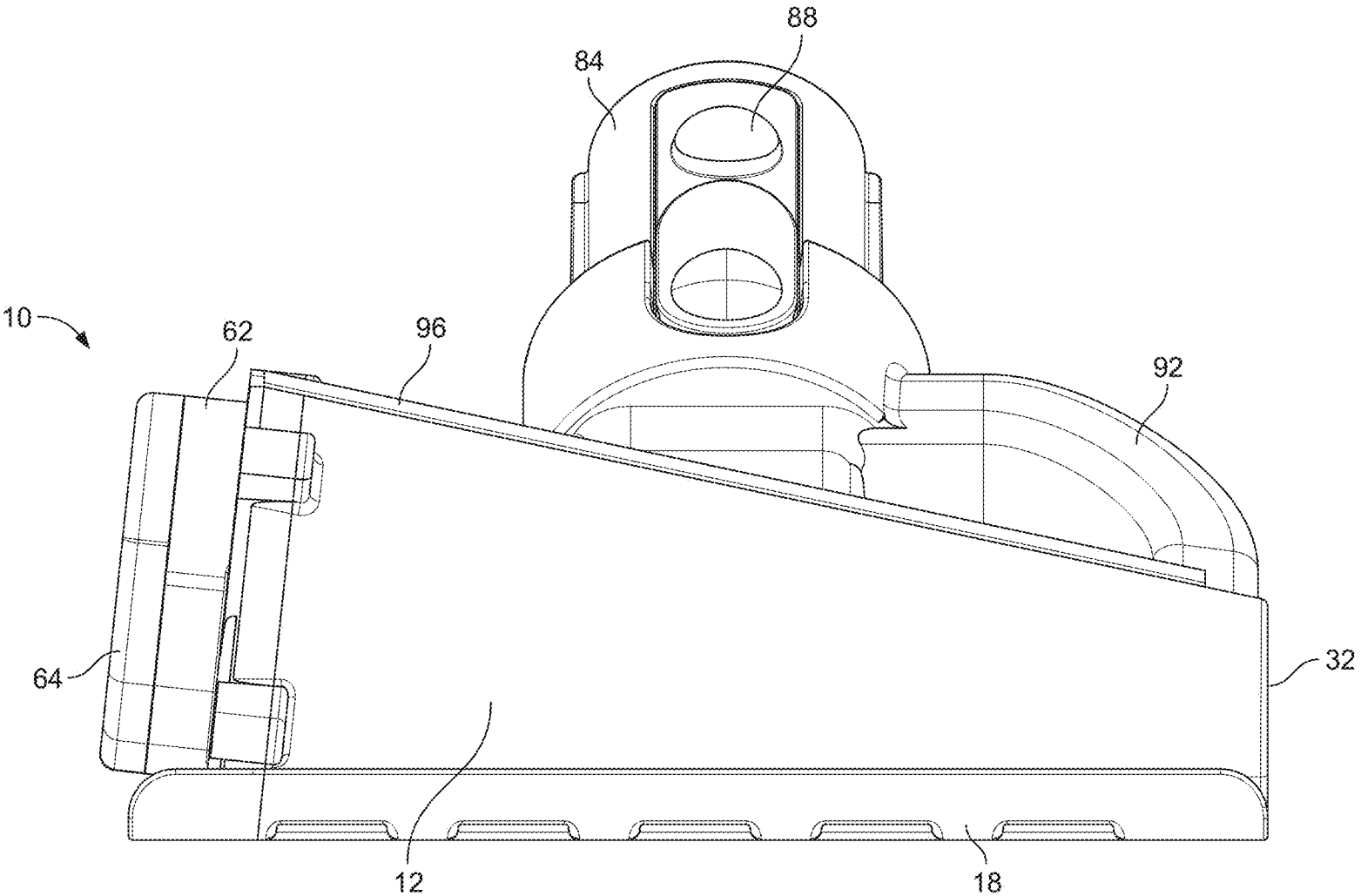
FIG. 1 is a front view of a first embodiment of a cleaner head for a vacuum cleaner.
Figure 2:
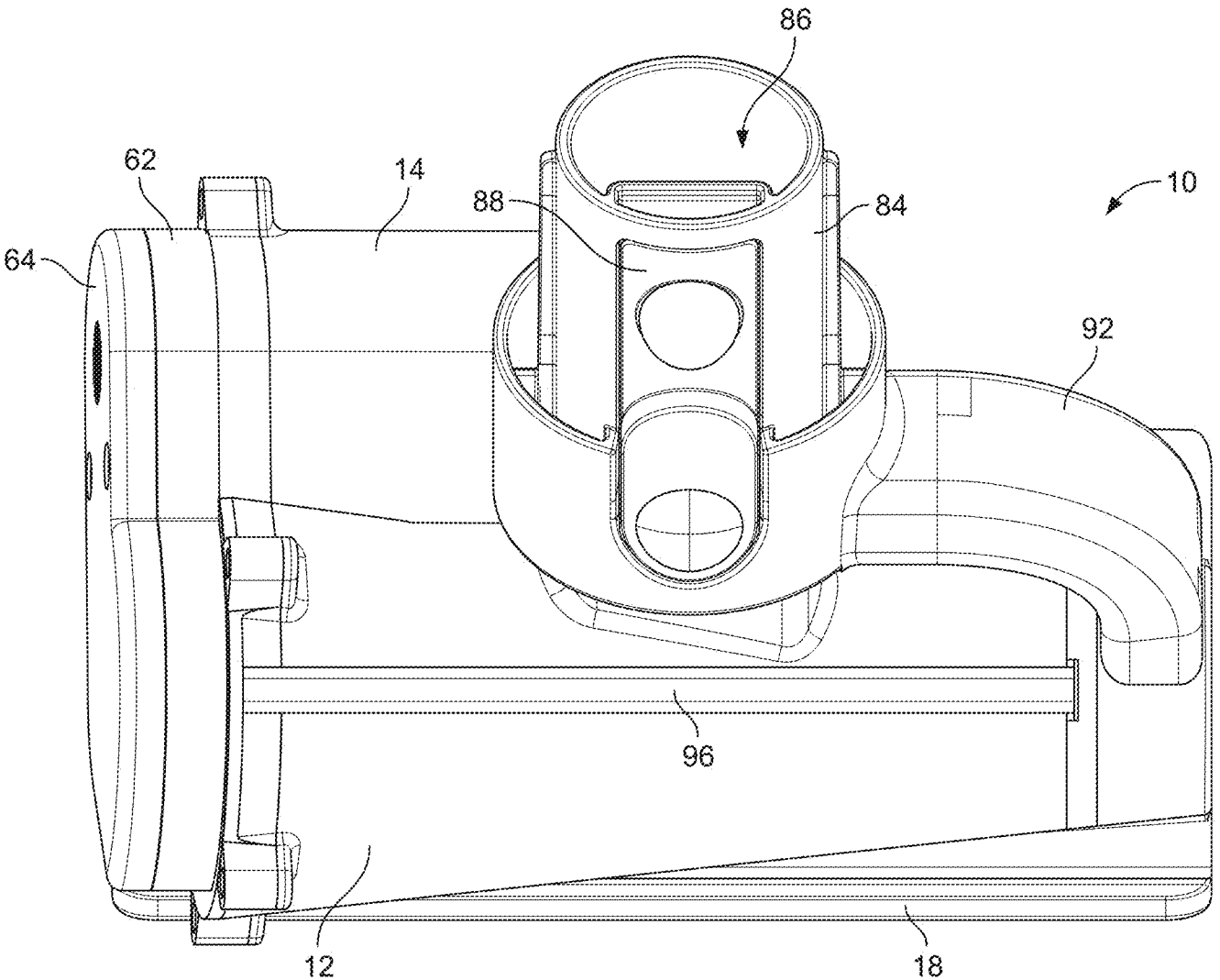
FIG. 2 is a top view of the cleaner head of FIG. 1.
Figure 3:
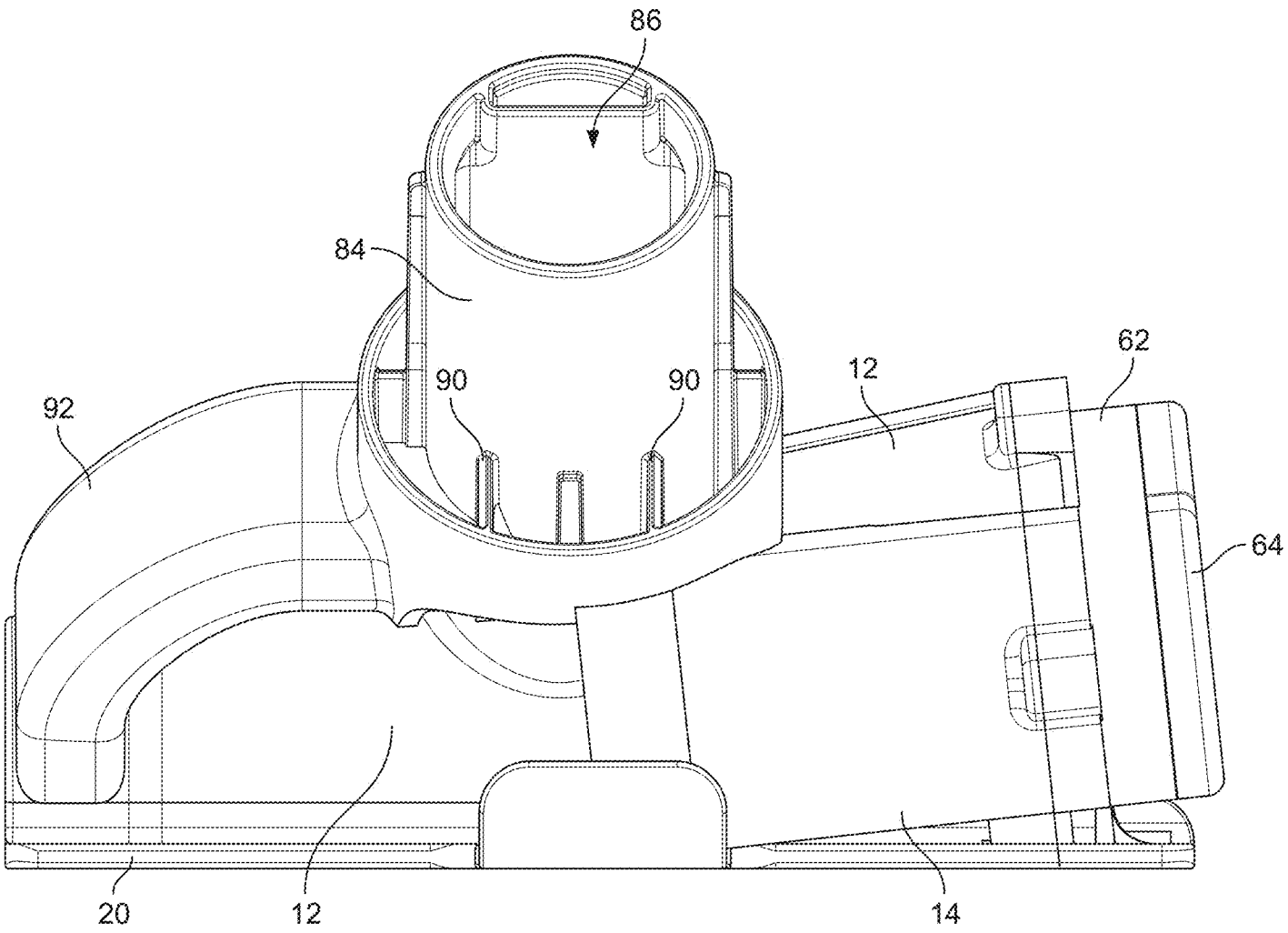
FIG. 3 is a rear view of the cleaner head of FIG. 1.
Figure 4:
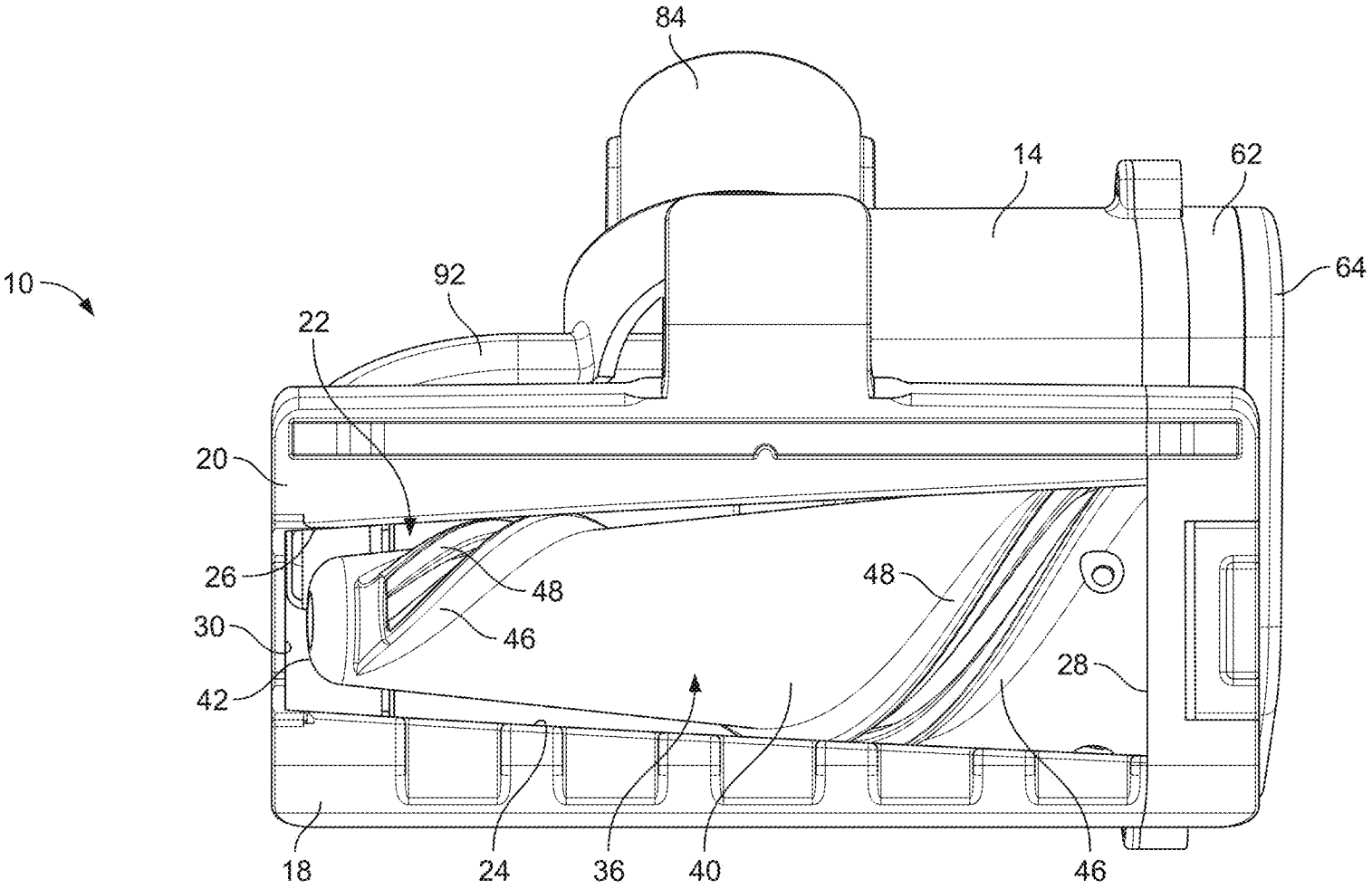
FIG. 4 is a bottom view of the cleaner head of FIG. 1.
Figure 5:
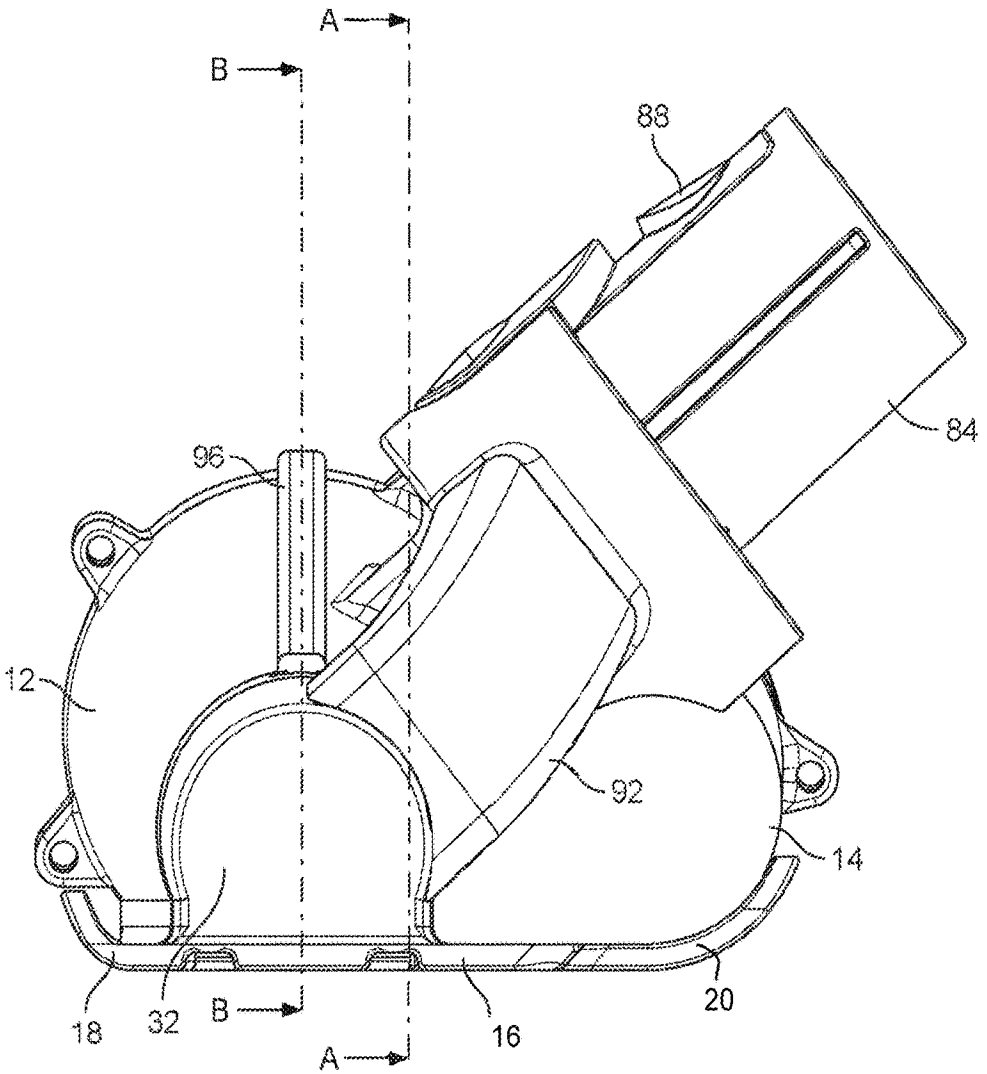
FIG. 5 is a side view of the cleaner head of FIG. 1.

With particular reference to FIG. 4, the sole plate 16 comprises a leading section 18 and a trailing section 20 located on opposite sides of a suction opening 22 through which an airflow is drawn into the cleaner head 10. The suction opening 22 is generally trapezoidal in shape, and is delimited by a front working edge 24, a rear working edge 26 which is inclined relative to the front working edge 24, a relatively long first side edge 28 and a relatively short, second side edge 30 which is parallel to the first side edge 28. The front working edge 24 is defined by the intersection of the leading section 18 of the sole plate 16 with the front housing 12, and the rear working edge 26 is defined by the intersection of the trailing section 20 of the sole plate 16 with the front housing 12. The working edges 24, 26 agitate the fibres of a carpeted floor surface as the cleaner head is manoeuvred over such a surface. The second side edge 30 is defined by the bottom end of a side wall 32 of the front housing 12.

Figure 6A:
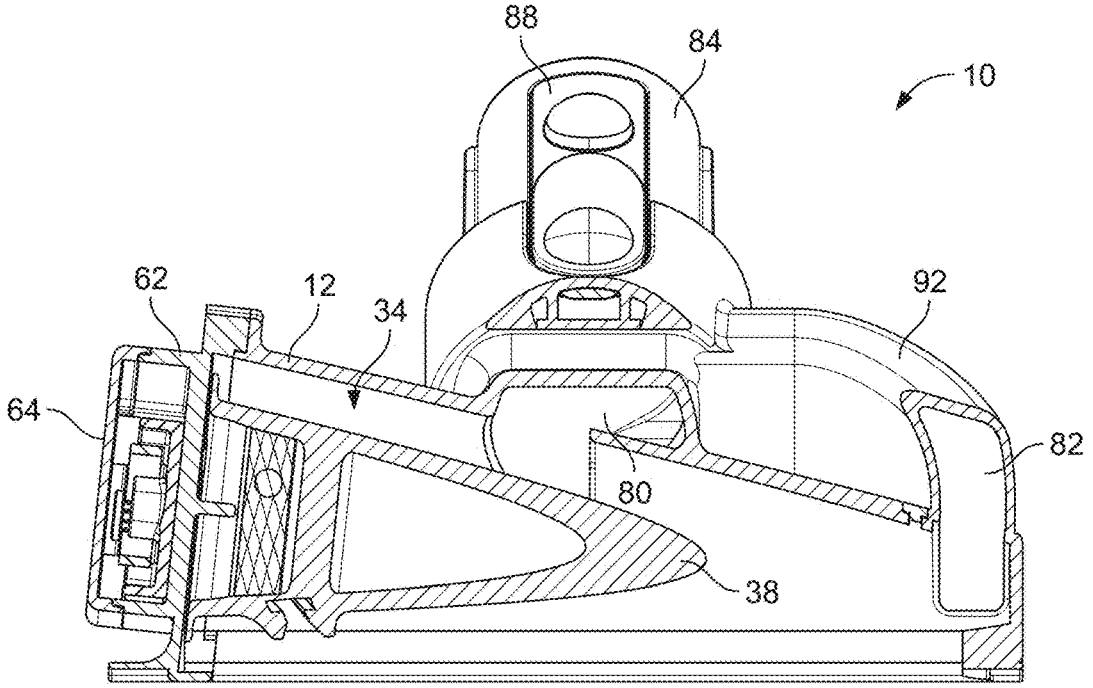
FIG. 6(*a*) is a sectional view taken along line A-A of FIG. 5, and FIG. 6(*b*) is a sectional view taken along line B-B of FIG. 5.
Figure 6B:
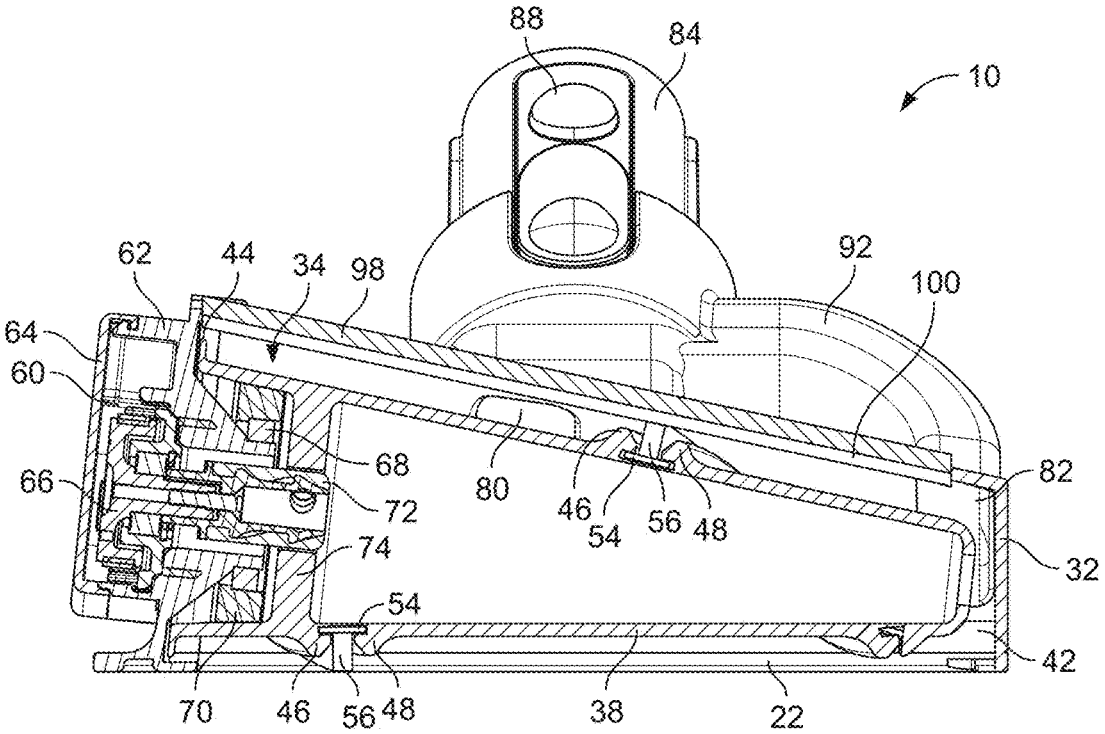
Figure 7B:
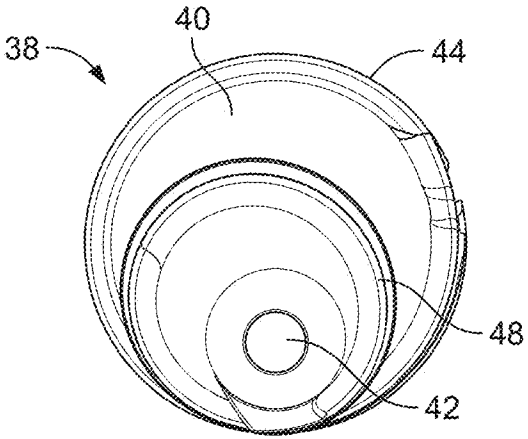
FIG. 7(*a*) is a front view of the core of an agitator of the cleaner head of FIG. 1, FIG. 7(*b*) is an end view of the agitator of FIG. 7(*a*), FIG. 7(*c*) is a side view of a row of bristles of the agitator, and FIG. 7(*d*) is a sectional view taken along line J-J in FIG. 7(*a*) but with the row of bristles located on the core.
Figure 7D:
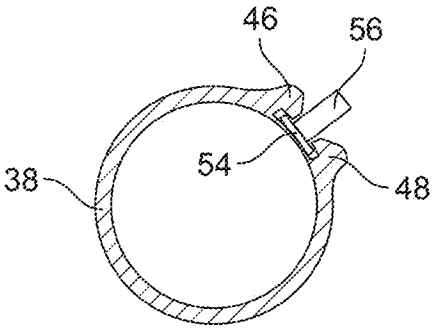
Figure 7A:
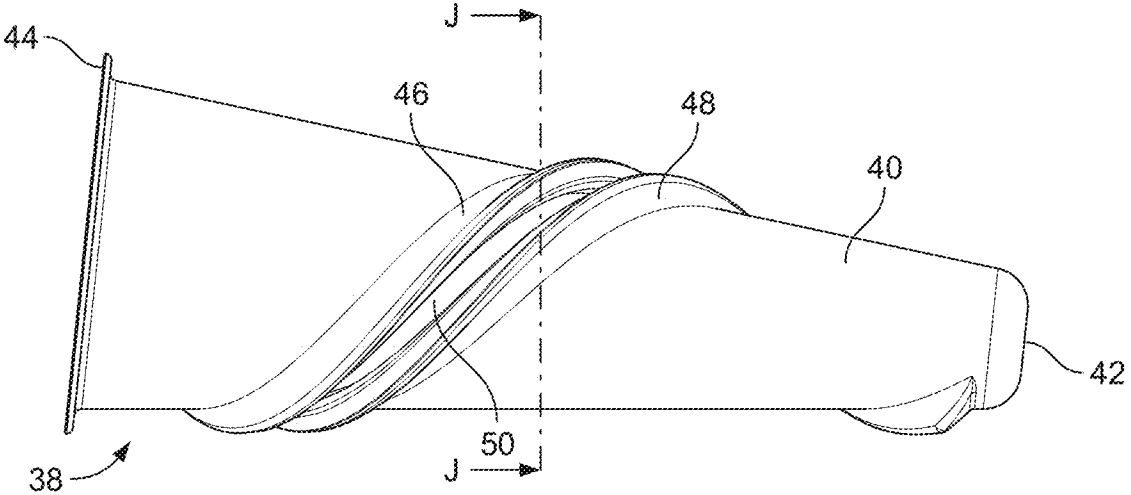
Figure 7C:
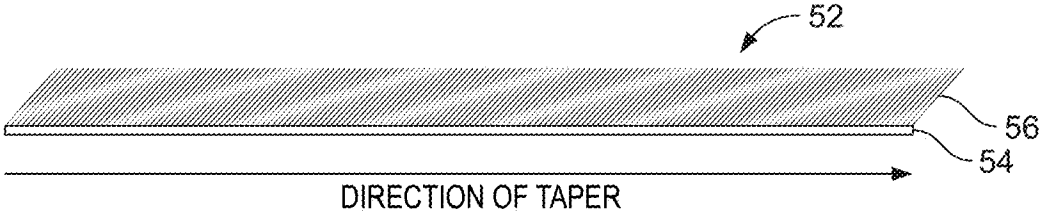

With reference also to FIGS. 6(*a*) and 6(*b*), the front housing 12 defines a conical suction cavity 34 which receives the airflow drawn into the cleaner head 10 through the suction opening 22. The suction cavity 34 houses an agitator 36 for agitating the fibres of a carpeted floor surface. The agitator 36 is in the form of a brush bar which is rotatable relative to the front housing 12, and suction cavity 34, about an axis which is collinear with the longitudinal axis of the agitator 36. As illustrated in FIGS. 7(*a*) to 7(*d*), the agitator 36 comprises a hollow core 38, which in this embodiment is conical in shape. The core 38 is formed from a relatively rigid plastics material, such as acrylonitrile butadiene styrene (ABS). The core 38 comprises a conical external surface 40 which extends between a relatively small first end 42 and a relatively large second end 44. The cone angle of the core 38, that is, the angle subtended between the longitudinal axis of the core and external surface 40 of the core 38, is preferably in the range from 5 to 15°, and in this embodiment is approximately 7°.

A pair of helical ridges 46, 48 are upstanding from the external surface 40 of the core 38, and extend helically along the external surface 40 of the core 38 from the second end 44 to the first end 42 thereof. The ridges 46, 48 extend substantially the entire length of the core 38, and extend about the external surface 40 by around 450°. The ridges 46, 48 are preferably integral with the core 38 so that the ridges 46, 48 do not deform excessively upon contact with a floor surface. The ridges 46, 48 define a helical channel 50 therebetween which receives a bristle strip 52 (not shown in FIG. 4). The bristle strip 52 comprises a flexible bristle base 54 and a row of bristles 56 woven into the bristle strip 54. The bristles 56 are formed from nylon, and have sufficient strength to agitate dust and debris located upon a surface to be cleaned in use, whilst still having sufficient flexibility to resiliently deform relative to the bristle base 54. As illustrated in FIG. 7(*c*), the bristles 56 are arranged on the bristle base 54 so that the bristles 56 are inclined at an acute angle to the bristle base 54. The inclination of the bristles 56 may be achieved following their attachment to the bristle base 54 by subjecting the bristles 56 to a hot rolling process to deform the bristles 56 so that they are inclined towards the bristle base 54. The acute angle is preferably in the range from 20 to 60°, more preferably in the range from 30 to 50°. The bristle strip 52 is then inserted into, and secured to, the channel 50 so that the direction of the taper of the bristles 56, as indicated in FIG. 7(*c*), extends towards the first end 42 of the core 42. The bristles 56 are thus inclined towards the first end 42 of the core 38, but such that the direction of taper extends helically about the core 38 from the second end 44 towards the first end 42 of the core 38.

The length of the bristles 56 is selected so that the bristles 56 protrude outwardly beyond the tips of the ridges 46, 48. As measured in a direction perpendicular to the longitudinal axis of the core 38, the height of the upstanding ridges 46, 48 is preferably at least 50% of the height of the bristles 56.

The agitator 36 is mounted within the suction cavity 34 in a cantilevered manner so that the first end 42 of the core 38 is spaced from the side wall 32 of the front housing 12. The first end 42 may thus be referred to as a free end of the agitator 36. The spacing between the first end 42 of the core 38 and the side wall 32 is preferably in the range from 2 to 10 mm, more preferably in the range from 3 to 5 mm. The agitator 36 is mounted so that the longitudinal axis of the agitator is inclined at an acute angle to a plane containing the suction opening 22. This acute angle is preferably in the range from 5 to 15°, and in this embodiment is approximately 7°. As illustrated in FIG. 6(*b*), the agitator 36 is mounted such that the lowermost portion of the external surface 40 of the core 38 is parallel to the plane containing the suction opening 22. The length of the bristles 56 is selected such that, when not subject to external forces, the lowermost tips of the bristle strip 52 are located in the plane containing the suction opening 22.

The rotation of the agitator 36 is driven by a motor (not shown) which is housed inside the rear housing 14. The motor is arranged to rotate the agitator 36 in such a direction that the bristles 56 sweep dirt and debris rearwardly, that is, over the rear working edge 26, into the suction cavity 34. The motor drives a belt 60 which extends between the front housing 12 and the rear housing 14 within a drive housing 62 which is closed by a cover 64. The belt 60 is arranged to drive rotation of a belt drive 66, which is mounted to a cantilever support defined by the drive housing 62. The cantilever support projects away from the belt drive 66 and provides a mount onto which the agitator 36 is rotatably mounted via bearings 68 and agitator fixings 70. A drive dog 72 is connected to the belt drive 66 so as to project through the cantilever support. The agitator 36 is connected to the drive dog 72 via an internal annular collar 74 of the core 38.

With reference to FIGS. 6(*a*) and 6(*b*), the suction cavity 34 comprises a first air outlet 80 and a second air outlet 82 which is spaced from the first air outlet 80. Each of the air outlets 80, 82 is located rearwardly of the agitator 36 and is located above the plane containing the suction opening 22. The first air outlet 80 is larger than the second air outlet 82. The first air outlet 80 is located generally midway between the first end 42 and the second end 44 of the core 38 of the agitator 36. The first air outlet 80 conveys air into a neck 84 of the cleaner head 10, within which the air is conveyed to an outlet 86 of the cleaner head 10. The neck 84 includes a connector 88 for connecting the cleaner head 10 to a vacuum cleaner, and electrical connectors 90 for connecting the motor to a power source of the vacuum cleaner.

The second air outlet 82 is located adjacent to the first end 42 of the core 38, and is preferably partially defined by the side wall 32 of the first housing 12. The second air outlet 82 conveys air into a duct 92 which extends externally between the first housing 12 and the neck 84. The duct 92 is preferably rigid and is preferably integral with at least part of the front housing 12 and/or at least part of the neck 84. The duct 92 conveys air from the second air outlet 82 to an air inlet port located within the neck 84, between the first air outlet 80 and the outlet 86 of the cleaner head 10.

Figure 8A:
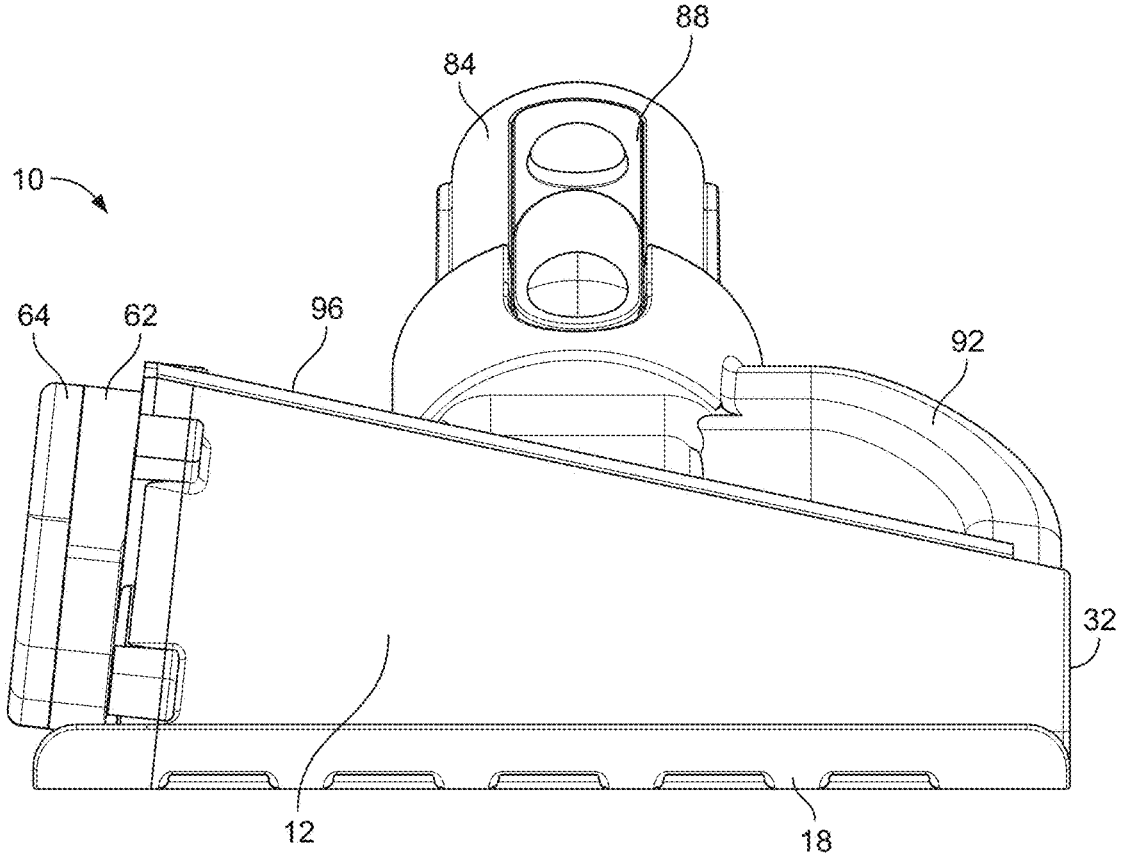
FIG. 8(*a*) is a front view of the cleaner head of FIG. 1, FIG. 8(*b*) is a similar view to FIG. 8(*a*) but with all components removed except an agitator engaging member of the cleaner head, and FIG. 8(*c*) is a sectional view taken along line M-M of FIG. 8(*b*)
Figure 8B:
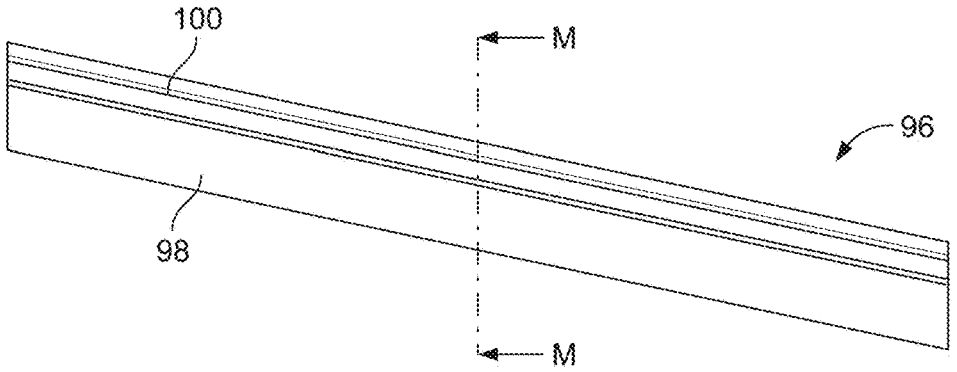
Figure 8C:
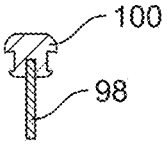
Figure 9:
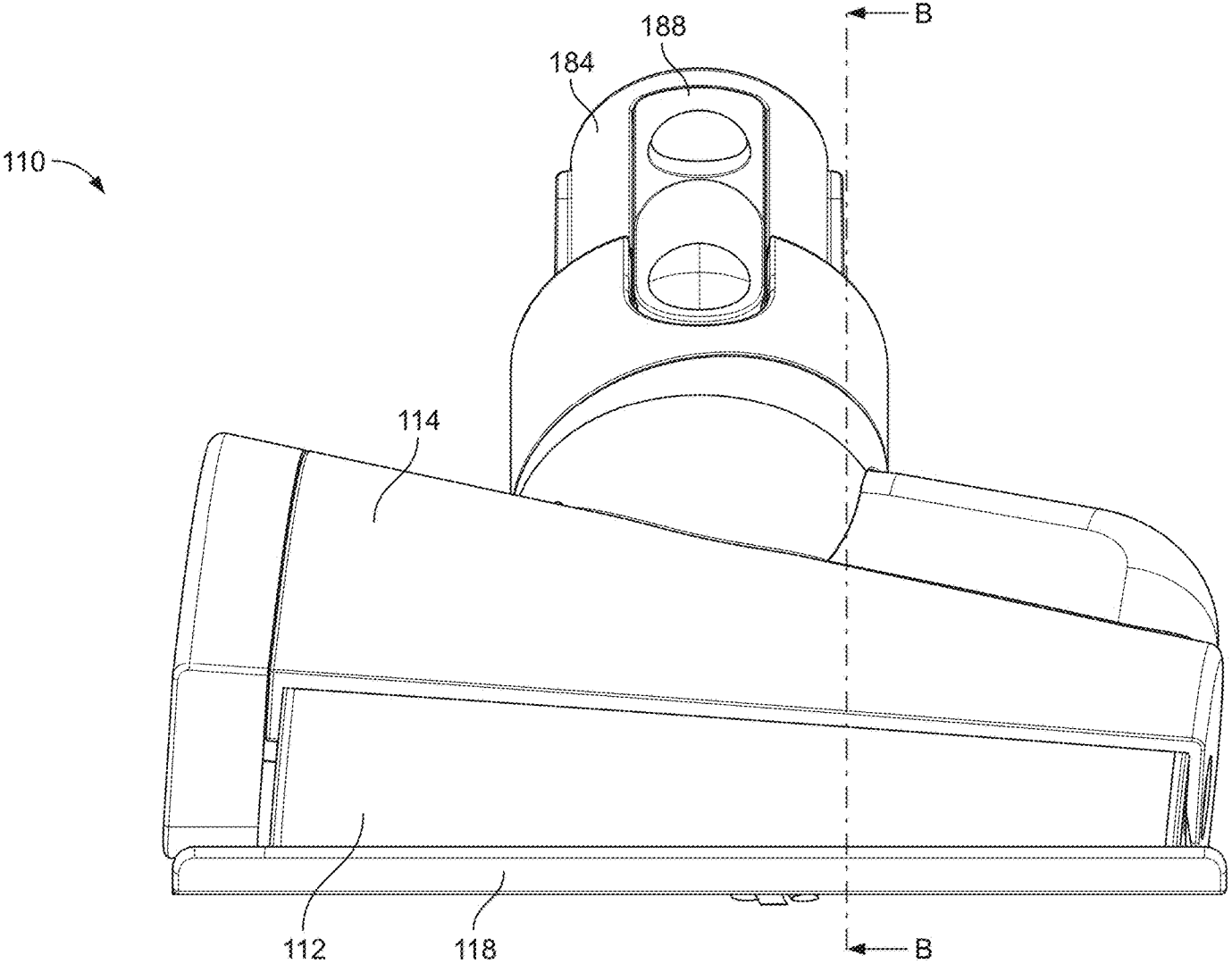
FIG. 9 is a front view of a second embodiment of a cleaner head for a vacuum cleaner.
Figure 10:
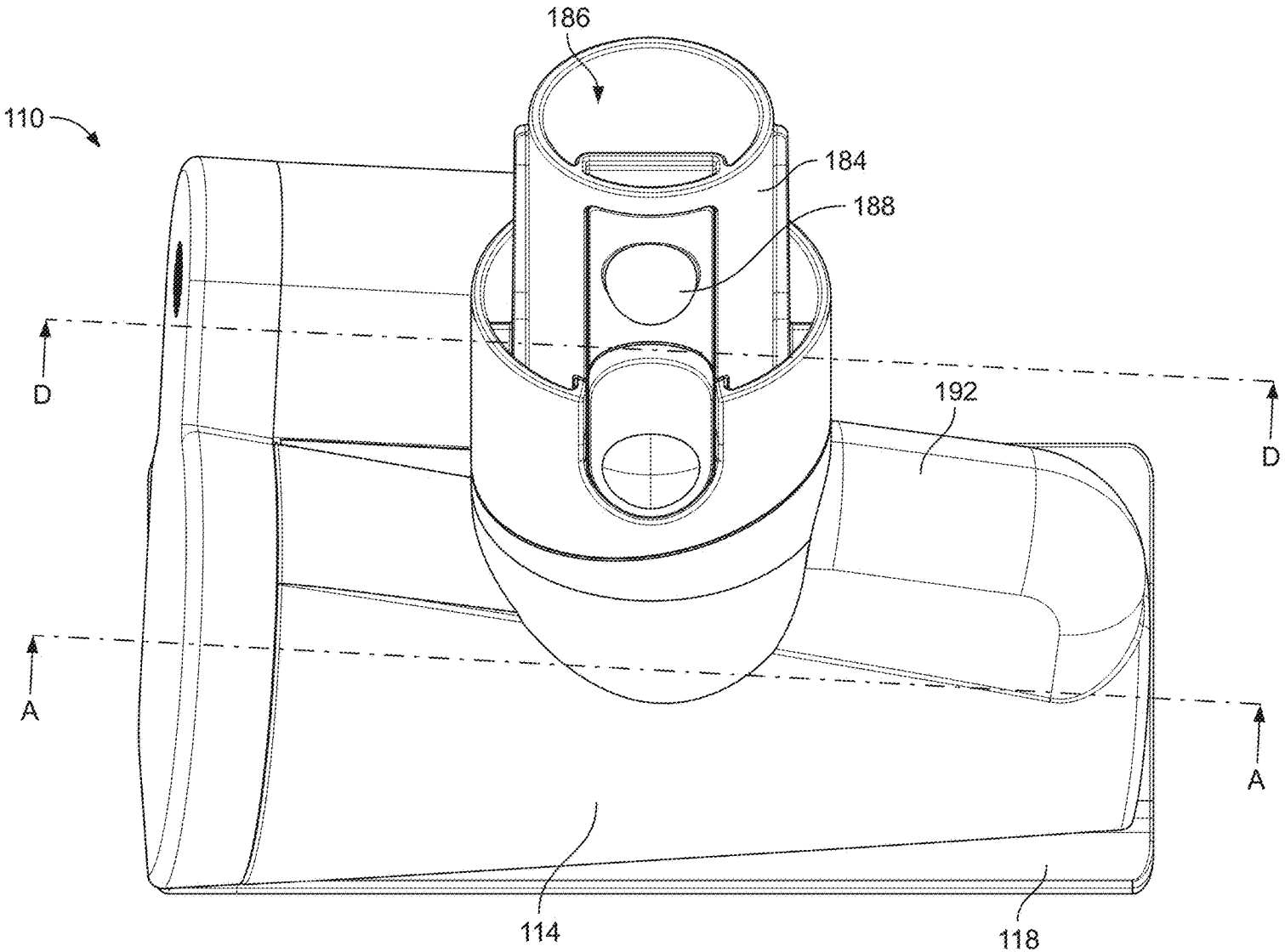
FIG. 10 is a top view of the cleaner head of FIG. 9.
Figure 11:
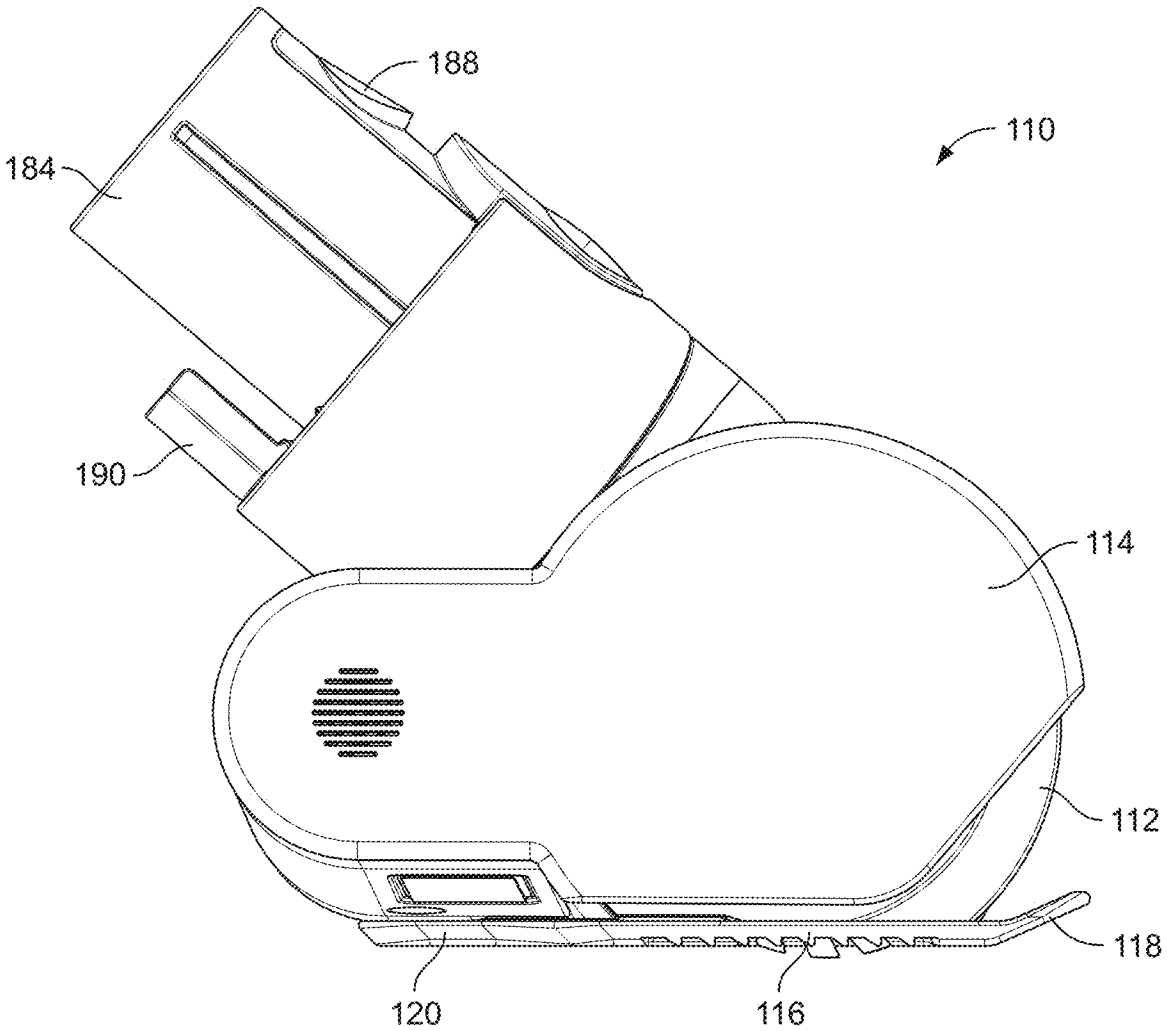
FIG. 11 is a side view of the cleaner head of FIG. 9.
Figure 12:
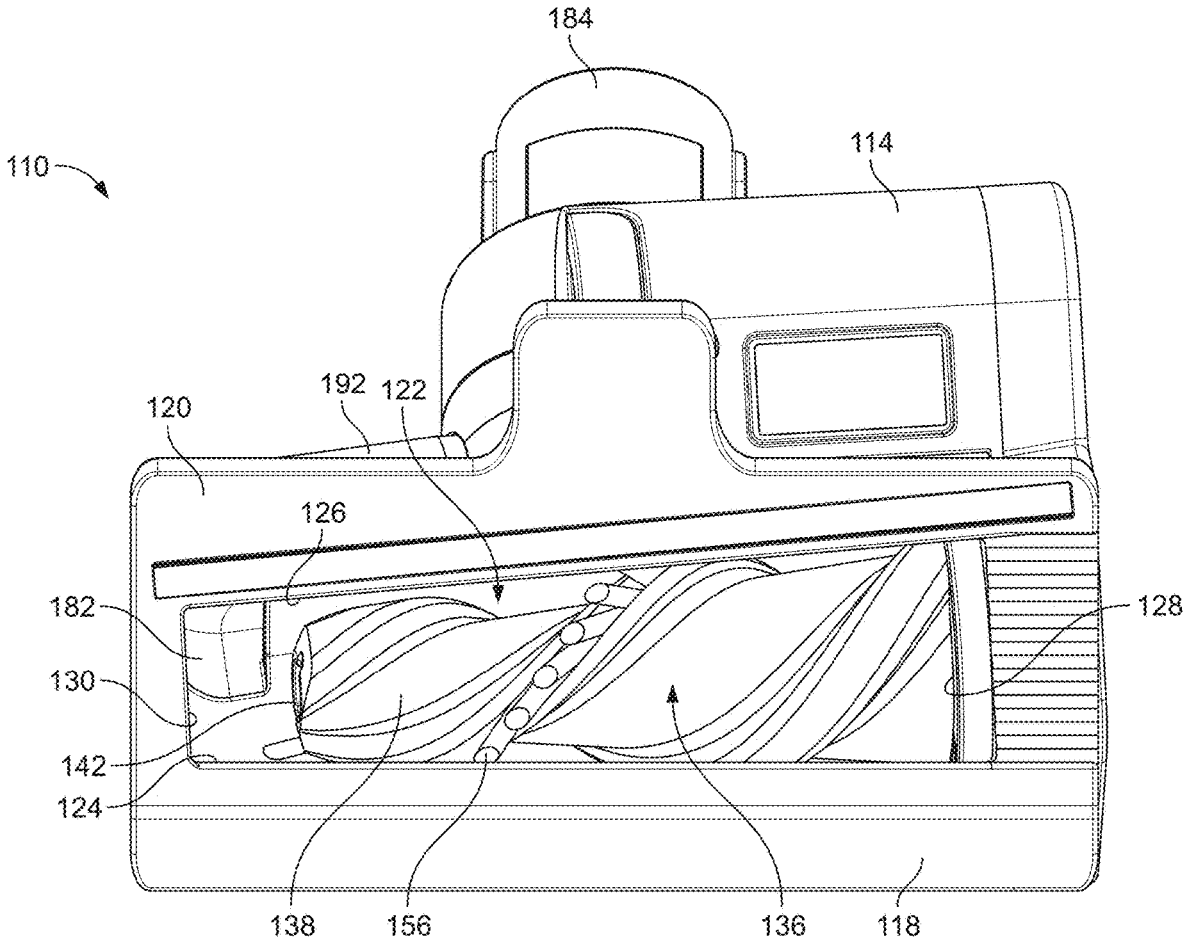
FIG. 12 is a bottom view of the cleaner head of FIG. 9.

With reference to FIG. 6(*b*) and FIGS. 8(*a*) to 8(*c*), the cleaner head 10 also includes an agitator engaging member 96 for engaging the agitator 36. The engaging member 96 is mounted on the first housing 12 so as to protrude into the suction cavity 34 to engage the agitator 36. The engaging member 96 comprises a flexible strip 98 of resilient material which is gripped by a support 100 along its length, and which presses against the at least the bristles 56 of the agitator 36. The engaging member 96 extends substantially the entire length of the agitator 36 so that, with rotation of the agitator 36, the engaging member 96 presses against substantially the entire row of bristles 56. As indicated in FIGS. 8(*a*) and 8(*b*), the engaging member 96 extends in a direction which is inclined at the cone angle to the longitudinal axis of the agitator 36 so that it lies substantially parallel to an upper portion of the external surface 40 of the core 38 of the agitator 36. The flexible strip 98 has substantially uniform width. In this embodiment, the width of the strip of resilient material is approximately 5 mm, and is selected so as to protrude sufficiently into the suction cavity 22 so as to engage at least the bristles 56 of the agitator 36, as shown in FIG. 6(*b*), but preferably also the tips of the ridges 46, 48 of the core 38. The engaging member 96 is located opposite to the suction opening 22, and preferably protrudes into the suction cavity 22 through a slot formed in the front housing 12.

In use, an airflow is drawn through the cleaner head 10 by the motor and fan unit of a vacuum cleaner to which the cleaner head 10 is attached. The airflow enters the suction cavity 34 through the suction opening 22. A first part of the airflow leaves the suction cavity 34 through the first air outlet 80 and passes along a first airflow path extending within the neck 84 from the first air outlet 80 to the outlet 86 of the cleaner head 10. A second part of the airflow leaves the suction cavity 34 through the second air outlet 82, and passes along a second airflow path extending within the duct 92 from the second air outlet 82 to the air inlet port of the neck 84, and thus towards the first airflow path. These parts of the airflow thus merge within the neck 84 of the cleaner head 10 before being emitted from the cleaner head 10 through the outlet 86.

The agitator 36 is driven by the motor to rotate within the suction cavity 34. With the sole plate 16 pressed against a carpeted floor surface, the rotating bristles 56 of the agitator 36 contact, and so transfer energy to, dust particles and debris located on the floor surface, or between the fibres of the floor surface. As the agitator 36 is rotated within the suction cavity 34 so that the bristles 56 pass from the front working edge 24 to the rear working edge 26, the majority of the energised dust and debris is swept rearwardly through the suction opening 22. Whilst the majority of the dust and debris will become entrained within the airflow passing through the suction cavity 34 and pass through the first air outlet 80 or second air outlet 82, some debris, such as hairs, threads, fibres and the like, can become wrapped around the agitator 36. Such debris is encouraged by the conical shape of the agitator 36 to migrate along the length of the agitator 36 from the second end 44 towards the first end 42. Under the action of the engaging member 96, such debris is pressed around the agitator 36 until it falls from the first end 42 of the agitator 36, whereupon the released debris becomes entrained within the second part of the airflow and passes through the duct 92 and into the neck 84 of the cleaner head 10. The inclination of the bristles 56 relative to the external surface 40 of the core 38 encourages the wrapped debris to migrate along the agitator, and not become trapped between the bristles 56. The relative heights of the bristles 56 and the ridges 46, 48 of the core 38 means that any wrapped debris which begins to migrate between bristles 56 towards the bristle strip 54 will be blocked from doing so by its engagement with the tips of the ridges 46, 48, and so continue to migrate along the agitator 36 towards the first end 42.

FIGS. 9 to 12 are external views of a second embodiment of a cleaner head 110 for a vacuum cleaner. The cleaner head 110 comprises a housing formed from a lower housing section 112 and an upper housing section 114 which is moveable relative to, and about, the lower housing section 112. A sole plate 116 is connected to, and is preferably integral with, the lower housing section 112. Similar to the sole plate 16 of the first embodiment, the sole plate 116 comprises a leading section 118 and a trailing section 120 located on opposite sides of a suction opening 122 through which an airflow is drawn into the cleaner head 110. The suction opening 122 is generally trapezoidal in shape, and is delimited by a front working edge 124, a rear working edge 126 which is inclined relative to the front working edge 124, a relatively long first side edge 128 and a relatively short, second side edge 130 which is generally parallel to the first side edge 128. The working edges 124, 126 agitate the fibres of a carpeted floor surface as the cleaner head 110 is manoeuvred over such a surface.

Figure 13:
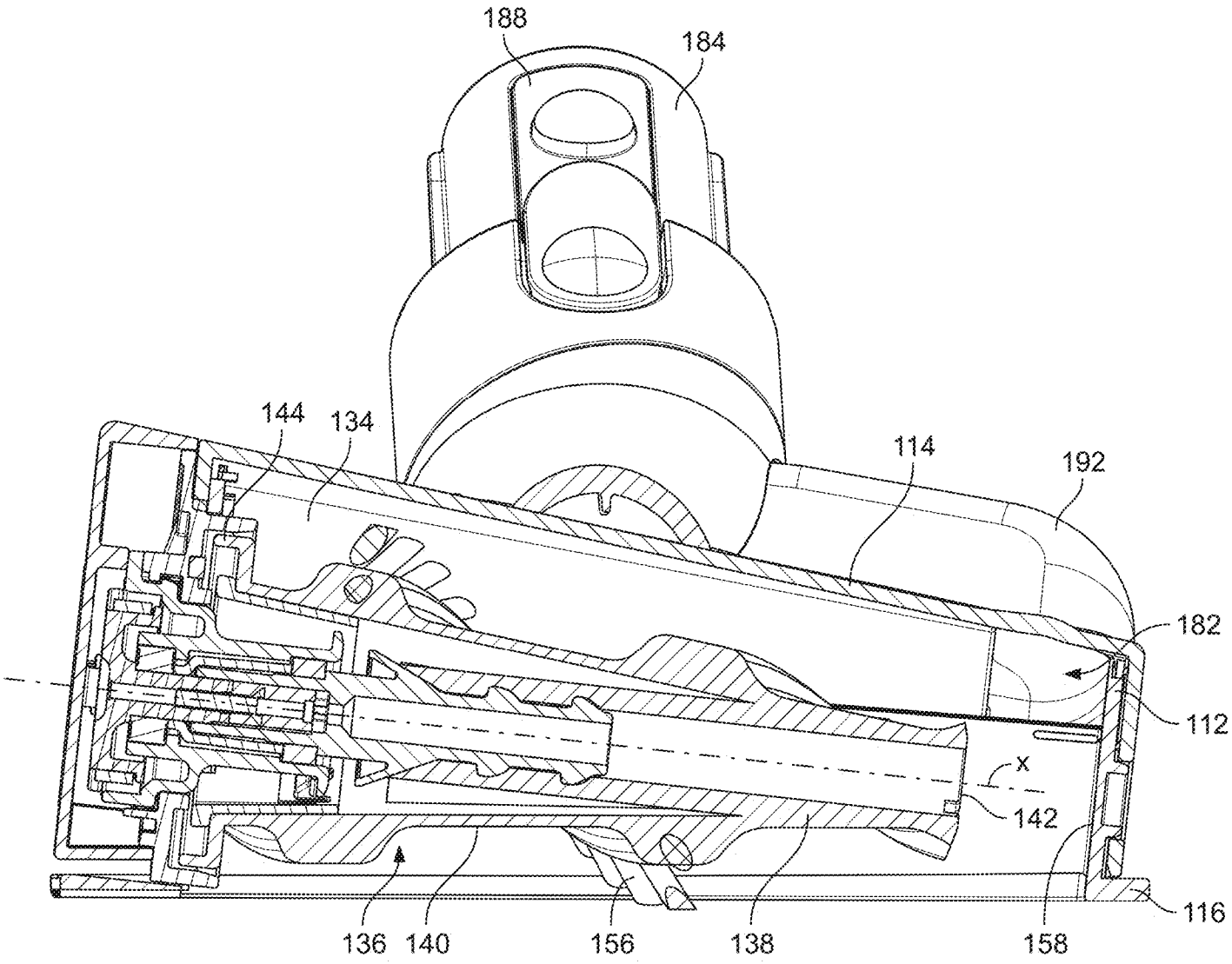
FIG. 13 is a sectional view taken along line A-A of FIG. 10.
Figure 15:
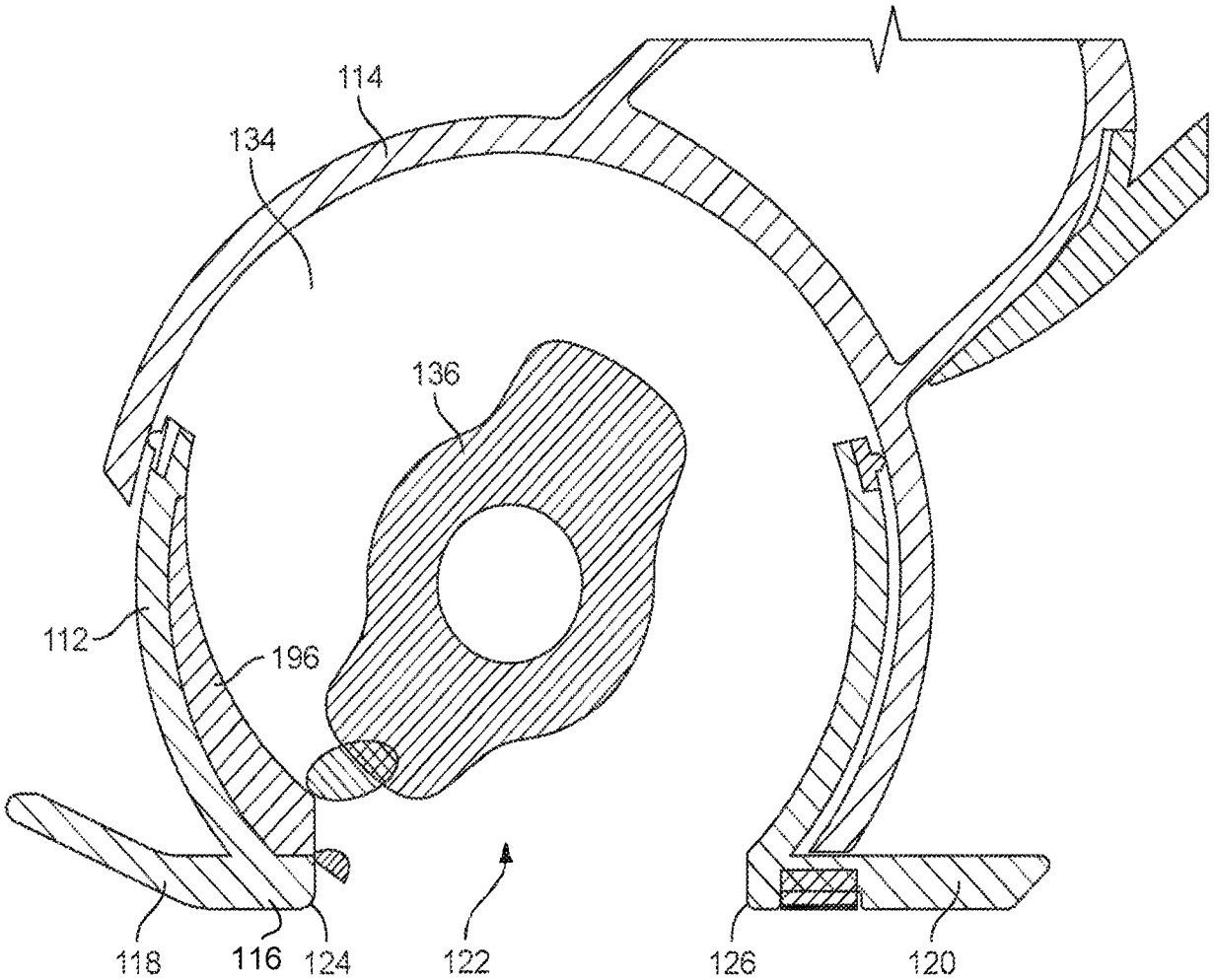
FIG. 15 is part of a sectional view taken along line B-B of FIG. 9.

With reference also to FIGS. 13 and 15, the lower housing section 112 and the upper housing section 114 define a conical suction cavity 134 which receives the airflow drawn into the cleaner head 110 through the suction opening 122. The suction cavity 134 houses an agitator 136 for agitating the fibres of a carpeted floor surface. The agitator 136 is in the form of a brush bar which is rotatable relative to the housing sections 112, 114 and suction cavity 134, about an axis which is collinear with the longitudinal axis of the agitator 136. As illustrated in FIG. 13, the agitator 136 comprises a hollow core 138, which in this embodiment is also conical in shape. The core 138 is formed from a relatively rigid plastics material, such as ABS. The core 138 comprises a conical external surface 140 which extends between a relatively small first end 142 and a relatively large second end 144. In this embodiment, the cone angle of the core 138 is approximately 5°.

In this embodiment, tufts of bristles 156 are mounted on the core 138 of the agitator 136. The tufts of bristles 156 are arranged in a helical row which extends about the core 138 of the agitator 136. The tufts of bristles 156 may be individually connected to the core 138, for example using a stapling technique. Alternatively, the tufts of bristles 156 may be provided in the form of a bristle strip in which tufts of bristles 156 are mounted on a bristle base which is inserted into a helical channel extending about the core 138. The bristles 156 are formed from nylon, and have sufficient strength to agitate dust and debris located upon a surface to be cleaned in use, whilst still having sufficient flexibility to resiliently deform relative to the bristle base or the core 138 of the agitator 136. Similar to the first embodiment, the bristles 156 are arranged on the core 138 so that the bristles 156 are inclined towards the first end 142 of the core 138, but such that the direction of the taper of the bristles 156 extends helically about the core 138 from the second end 144 towards the first end 142 of the core 138.

As in the first embodiment, the agitator 136 is mounted within the suction cavity 134 in a cantilevered manner so that the first end 142 of the core 138 is spaced from the side wall 158 of the lower housing section 112. In this embodiment, the spacing between the first end 142 of the core 138 and the side wall 158 is preferably in the range from 10 to 20 mm. The agitator 136 is mounted so that the longitudinal axis of the agitator 136 is inclined at an acute angle to a plane containing the suction opening 122. This acute angle is preferably in the range from 5 to 15°, and in this embodiment is approximately 5°. As illustrated in FIG. 13, the agitator 136 is mounted such that the lowermost portion of the external conical surface 140 of the core 138 is parallel to the plane containing the suction opening 122. The length of the bristles 156 is selected such that, when not subject to external forces, the lowermost tips of the bristles 156 are located beneath the plane containing the suction opening 122.

Figure 14:
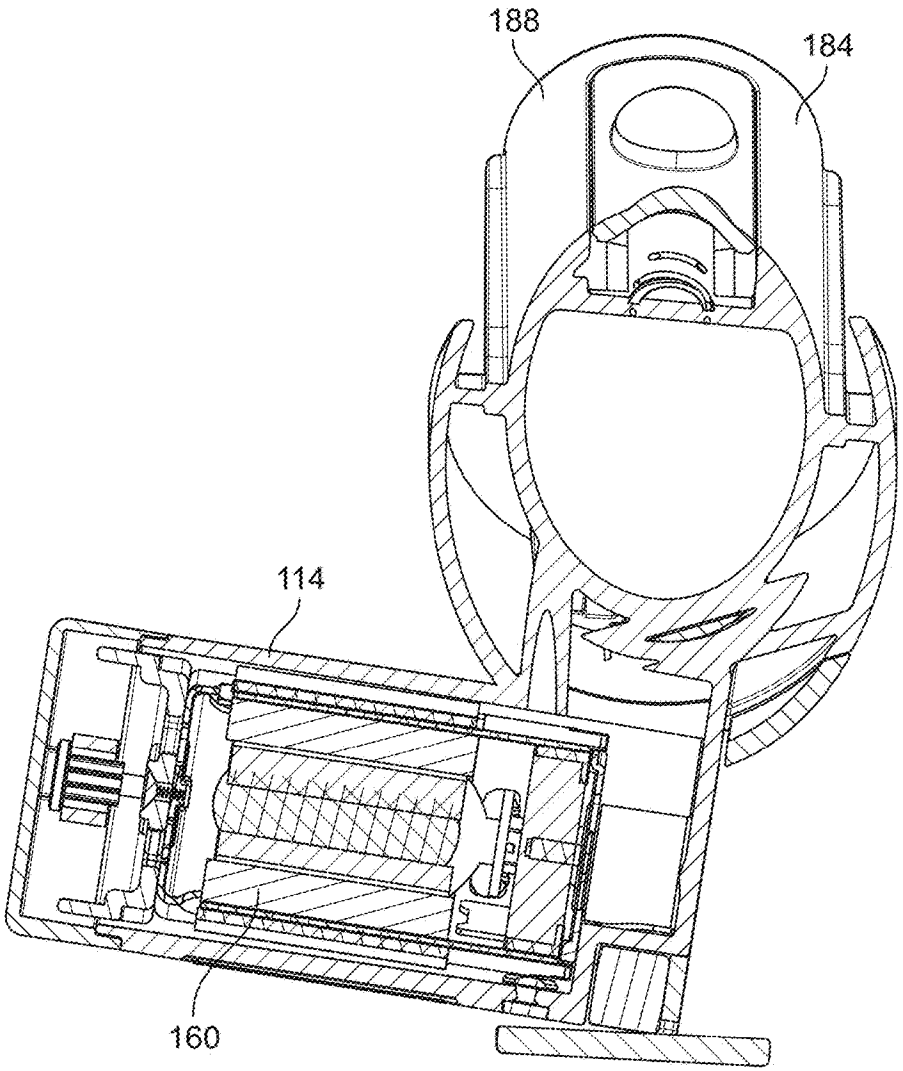
FIG. 14 is a sectional view taken along line D-D of FIG. 10.

The rotation of the agitator 136 is driven by a motor 160, illustrated in FIG. 14, which is housed inside the upper housing section 114. The motor is arranged to rotate the agitator 136 in such a direction that the bristles 156 sweep dirt and debris rearwardly, that is, over the rear working edge 126, into the suction cavity 134. The connection of the motor 160 to the agitator 136 is the same as the connection of the motor to the agitator 36 of the cleaner head 10.

In this embodiment, the suction cavity 134 comprises a single air outlet 182. The air outlet 182 is located in a similar position to the air outlet 82 of the cleaner head 10; the air outlet 182 is located rearwardly of the agitator 136 and is located above the plane containing the suction opening 122. With particular reference to FIG. 13, in this embodiment though the air outlet 182 is spaced from the free end 142 of the agitator 136 along the longitudinal axis X of the agitator 136. The spacing of the air outlet 182 from the free end 142 of the agitator 136 along this direction is preferably less than 10 mm, more preferably less than 5 mm. The air outlet 182 conveys air into a duct 192 which extends externally between the upper housing section 114 and a neck 184 of the cleaner head 110. The duct 192 is preferably rigid and is preferably integral with the upper housing section 114 and/or at least part of the neck 184. The duct 192 conveys air from the air outlet 182 to an air inlet port located within the neck 184 between the housing and the outlet 186 of the cleaner head 110. As in the first embodiment, the neck 184 includes a connector 188 for connecting the cleaner head 110 to a vacuum cleaner, and electrical connectors 190 for connecting the motor 160 to a power source of the vacuum cleaner.

With reference to FIG. 15, the cleaner head 110 also includes an agitator engaging member 196 for engaging the agitator 136. The engaging member 196 is mounted on the inner surface of the lower housing section 112 so as to protrude into the suction cavity 134 to engage the agitator 136. The engaging member 196 extends substantially the entire length of the agitator 136 so that, with rotation of the agitator 136, the engaging member 196 presses against substantially the entire row of bristles 156. In this embodiment, the engaging member 196 is located adjacent the suction opening 122 of the cleaner head 110.

In use, an airflow is drawn through the cleaner head 110 by the motor and fan unit of a vacuum cleaner to which the cleaner head 110 is attached. The airflow enters the suction cavity 134 through the suction opening 122. The airflow leaves the suction cavity 134 through the air outlet 182, and passes along an airflow path extending within the duct 192 from the air outlet 182 to the air inlet port of the neck 184, and then from the air inlet port to the air outlet 186. The agitator 136 is driven by the motor 160 to rotate within the suction cavity 134. With the sole plate 116 pressed against a carpeted floor surface, the rotating bristles 156 of the agitator 136 contact, and so transfer energy to, dust particles and debris located on the floor surface, or between the fibres of the floor surface. As the agitator 136 is rotated within the suction cavity 134 so that the bristles 156 pass from the front working edge 124 to the rear working edge 126, the majority of the energised dust and debris is swept rearwardly through the suction opening 122. Whilst the majority of the energised dust and debris becomes entrained within the airflow passing through the suction cavity 134 and passes through the air outlet 182, some debris, such as hairs, threads, fibres and the like, can become wrapped around the agitator 136. Such debris is encouraged by the conical shape of the agitator 136 to migrate along the length of the agitator 136 from the second end 144 towards the first end 142. Under the action of the engaging member 196, such debris is pressed around the agitator 136 until it falls from the first end 412 of the agitator 136, whereupon the released debris becomes entrained within the airflow and passes through the duct 192 and into the neck 184 of the cleaner head 10. As in the first embodiment, the inclination of the bristles 156 relative to the external surface 140 of the core 138 encourages the wrapped debris to migrate along the agitator 136.

The invention claimed is:

1. A cleaner head for a vacuum cleaner, the cleaner head comprising:

a conical suction cavity comprising an opening through which debris enters the cleaner head, and an outlet; and a conical single agitator mounted in the suction cavity to extend across the outlet of the suction cavity in a cantilevered manner for rotation relative thereto, the agitator comprising:

a conical core having a first, free end, a second end remote from the free end, and upstanding helical ridges extending between the free end and the second end; and a row of bristles located between the helical ridges and inclined relative to the core in a direction extending towards the free end of the core.

2. The cleaner head as claimed in claim 1, wherein the row of bristles extends towards the free end of the core in a helical direction, and wherein bristles of the row of bristles are inclined towards the free end of the core at an acute angle relative to the helical direction.

3. The cleaner head as claimed in claim 2, wherein the acute angle is in the range from 20 to 60°.

4. The cleaner head as claimed in claim 2, wherein the acute angle is in the range from 30 to 50°.

5. The cleaner head as claimed in claim 1, wherein, as measured in a direction perpendicular to a longitudinal axis of the core, a height of the upstanding ridges is at least 50% of a height of bristles of the row of bristles.

6. The cleaner head as claimed in claim 1, wherein the core is conical in shape, the free end of the core having a smaller diameter than the second end of the core.

7. The cleaner head as claimed in claim 6, wherein the cleaner head comprises a sole plate in which the opening is formed, and wherein a lowermost portion of an external surface of the core is parallel with the sole plate.

8. The cleaner head as claimed in claim 6, wherein the suction cavity is defined by a substantially conical housing of the cleaner head.

9. The cleaner head as claimed in claim 1, further comprising a drive operable to drive rotation of the agitator, and wherein the agitator is connected to the drive at or towards the second end of the agitator.

10. The cleaner head as claimed in claim 9, wherein the drive comprises a motor located externally of the agitator, and a belt connecting the agitator to the motor.

11. The cleaner head as claimed in claim 1, wherein the row of bristles comprises a continuous row of bristles.

12. The cleaner head as claimed in claim 1, wherein the row of bristles comprises a plurality of discrete bristle tufts.

13. The cleaner head as claimed in claim 1, further comprising:

a flexible bristle base insertable between the upstanding helical ridges of the core.

14. The cleaner head as claimed in claim 13, wherein bristles of the row of bristles are mounted on the flexible bristle base.

15. The cleaner head as claimed in claim 14, wherein the bristles are arranged relative to the upstanding helical ridges of the core to bend freely against the upper surfaces of the helical ridges as debris becomes wrapped around the agitator.

16. The cleaner head as claimed in claim 1, wherein as measured in a direction perpendicular to a longitudinal axis of the core, a height of the upstanding ridges is about 50% of a height of bristles of the row of bristles.

17. The cleaner head as claimed in claim 1, wherein:

the agitator defines a longitudinal axis; and the agitator is mounted so that the longitudinal axis of the agitator is inclined at an acute angle relative to a plane containing a suction opening defined by the suction cavity.

18. The cleaner head as claimed in claim 1, wherein the acute angle is in the range from 5° to 15°.

19. The cleaner head as claimed in claim 1, wherein the outlet of the suction cavity is located generally midway between the first and second ends of the core of the agitator.

20. A cleaner head for a vacuum cleaner, the cleaner head comprising:

a conical suction cavity comprising an opening through which debris enters the cleaner head, and an outlet; and a conical single agitator mounted in the suction cavity in a cantilevered manner for rotation relative thereto and to extend across the suction cavity and overlapping the outlet of the suction cavity, the agitator comprising:

a conical core having a first, free end, a second end remote from the free end, and upstanding helical ridges extending between the free end and the second end; and a row of bristles located between the helical ridges and inclined relative to the core in a direction extending towards the free end of the core.

* * * * *